US007761041B2

(12) United States Patent
Maeyama et al.

(10) Patent No.: US 7,761,041 B2
(45) Date of Patent: Jul. 20, 2010

(54) DEVELOPING APPARATUS, IMAGE FORMING APPARATUS AND METHOD FOR FORMING IMAGE USING OPPOSITE POLARITY PARTICLES

(75) Inventors: Takeshi Maeyama, Ikeda (JP); Toshiya Natsuhara, Takarazuka (JP); Junya Hirayama, Takarazuka (JP); Shigeo Uetake, Takarazuka (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 287 days.

(21) Appl. No.: 11/985,233

(22) Filed: Nov. 14, 2007

(65) Prior Publication Data

US 2008/0118279 A1 May 22, 2008

(30) Foreign Application Priority Data

Nov. 21, 2006 (JP) ..... 2006-314020
Oct. 22, 2007 (JP) ..... 2007-273495

(51) Int. Cl.
*G03G 15/08* (2006.01)

(52) U.S. Cl. ..... 399/281; 399/270; 399/272

(58) Field of Classification Search ..... 399/266, 399/270, 271, 272, 279, 281, 282, 285
See application file for complete search history.

(56) References Cited

U.S. PATENT DOCUMENTS

| | | | | |
|---|---|---|---|---|
| 5,991,587 | A | 11/1999 | Kikuchi | |
| 6,512,909 | B2 | 1/2003 | Ozawa et al. | |
| 6,721,516 | B2 | 4/2004 | Aoki et al. | |
| 2006/0222390 | A1 * | 10/2006 | Sasaki et al. | 399/55 |

FOREIGN PATENT DOCUMENTS

| | | |
|---|---|---|
| JP | 59-100471 | 6/1984 |
| JP | 09-185247 | 7/1997 |
| JP | 2000-298396 | 10/2000 |
| JP | 2002-108104 | 4/2002 |
| JP | 2003-057882 | 2/2003 |
| JP | 2003-215855 | 7/2003 |
| JP | 2005-189708 | 7/2005 |

* cited by examiner

*Primary Examiner*—Hoang Ngo
(74) *Attorney, Agent, or Firm*—Brinks Hofer Gilson & Lione

(57) ABSTRACT

The present invention provides a developing apparatus using a two-component developer, an image forming apparatus, and a method of forming an image capable of forming a high quality image characterized by stable suppression of carrier deterioration and absence of a residual image (memory effect) for a long period of time. The voltage formed by overlapping AD voltage to DC voltage is applied separately to each of the developer carrying member and the toner carrying member. The toner separation field made up of AC field is formed between the developer carrying member and the toner carrying member, and the development electric field made up AC field is formed between the toner carrying member and the image carrying member.

18 Claims, 4 Drawing Sheets

DEVELOPING APPARATUS, IMAGE FORMING APPARATUS AND METHOD FOR FORMING IMAGE USING OPPOSITE POLARITY PARTICLES

This application is based on Japanese Patent Application No. 2006-314020 filed on Nov. 21, 2006, and No. 2007-273495 on Oct. 22, 2007 in Japanese Patent Office, the entire content of which is hereby incorporated by reference.

TECHNICAL FIELD

The present invention relates to a developing apparatus for developing an electrostatic latent image on an image carrying member using the developer containing toner and carrier, an image forming apparatus, and an method for forming an image.

BACKGROUND

In an image forming apparatus using electrophotographic technology, a one-component development system using only toner as a developer and a two-component development system using both toner and carrier have been known as the methods of developing an electrostatic latent image formed on an image carrying member in the conventional art.

In the one-component development system, toner is generally made to pass through the regulating section formed by a toner carrying member and a regulating plate pressed to the toner carrying member, whereby the toner is charged and is formed into a desired thin toner layer so that an electrostatic latent image is developed. Thus, development is carried out with the toner carrying member placed close to the image carrying member, and this arrangement provides excellent dot reproducibility. And due to a uniform thin toner layer, a uniform image is ensured without irregularity in the image due to a magnetic brush, as is often observed in the two-component development system. This arrangement provides further advantages of simplified apparatus structure, downsized configuration and reduced cost. On the other hand, toner surface is degenerated and charge receptivity is reduced due to heavy stress in the regulating section. Further, the toner regulating member and toner carrying member surface are contaminated by deposition of the toner and external additive agent, and the performance of applying electric charge to toner is reduced. Thus, fogging and contamination inside the apparatus are caused by poorly-charged toner, with the result that the service life of the developing apparatus is reduced.

In the two-component development system, in the meantime, charging is caused by triboelectric charging due to mixture of toner and carrier. This method reduces stress and provides greater resistance to toner deterioration. Further, the carrier as a charge-applying member to toner has a greater surface area, and therefore, this method provides a relatively higher resistance to contamination due to toner and external additive agent, and ensures longer service life.

However, even if the two-component developer is employed, the carrier surface is contaminated by toner and external additive agent all the same. The amount of charge is reduced due to a long-term use, and fogging and toner splashing are caused as a result. The service life cannot be sufficient. There is a need for still longer service life.

A developing apparatus for prolonging the service life of the two-component developer is disclosed in the Unexamined Japanese Patent Application Publication No. S59-100471, wherein the carrier independently or together with toner is supplied little by little, and the deteriorated developer of reduced charging ability is removed accordingly. Thus, the carrier is replaced by new one, and an increase in the proportion of the deteriorated carrier is suppressed. In this apparatus, the reduction in the amount of charging the toner due to carrier deterioration is kept to a predetermined level by replacing the carrier. This arrangement provides advantages in prolonging the service life.

The Unexamined Japanese Patent Application Publication No. 2003-215855 discloses the two-component developer made up of the carrier and toner in which externally added are particles having a charging ability opposite to the polarity of the toner, as well as the development method using this developer. In this development method, the particles having a charging ability opposite to the polarity of the toner are supplied to serve as abrasive powder and spacer particle. It has been demonstrated that deterioration can be effectively suppressed by the effect of removing spent matter on the carrier surface. Further, the cleaning section of the image carrying member is claimed to have the effect of improving the cleaning performance and polishing the image carrying member.

The Unexamined Japanese Patent Application Publication No. H9-185247 discloses the so-called hybrid development system wherein only the toner in the two-component developer is carried on the toner carrying member placed face to face with the image carrying member, thereby developing the electrostatic latent image on the image carrying member. The hybrid development system provides excellent dot reproducibility and image uniformity without image irregularities being caused by a magnetic brush. Due to absence of direct contact between the image carrying member and magnetic brush, movement of the carrier to the image carrying member (carrier consumption) does not occur. This method provides these advantages that cannot be found in the conventional two-component development system. In the hybrid development system, toner is charged by triboelectric charging with the carrier. It is important to maintain excellent carrier charge-applying property for the purpose of stabilizing charging ability of toner, and ensuring a high degree of image quality for a long period of time.

However, one of the common problems with the hybrid development system is that the toner having a high degree of development performance tends to be moved onto the electrostatic latent image carrying member. When continuous printing is performed, the phenomenon of selection occurs wherein the toner of high electrostatic charge performance is accumulated on the toner carrying member, with the result that image density is reduced. Thus, if a toner consumption area and a non-consumption area appear on the toner carrying member, variations occur in the deposition of toner on the toner carrying member and the potential difference of toner. Accordingly, hysteresis occurs at the time of the next development, wherein part of the previous development image appears as a residual image (memory effect). To solve this problem, for example, the Unexamined Japanese Patent Application Publication No. 2002-108104 proposes a developing apparatus wherein the toner on the toner carrying member is recovered by a two-component developer during the non-image formation period among images so as to avoid a residual image.

However, in the Unexamined Japanese Patent Application Publication No. S59-100471, a mechanism for collecting the carrier having been ejected must be installed and a consumable carrier must be used. This has given rise to problems in terms of cost and environment. Further, the required amount of printing must be repeated until the proportion of the new and old carrier is stabilized. Maintenance of the initial characteristics is not necessarily possible. In the Unexamined Japanese Patent Application Publication No. 2003-215855, depending on the image area rate, there is a difference in the amount of consumption of the particles charged opposite to the polarity of the toner. Specifically, when the image area rate is small, there is excessive consumption of the particles charged opposite to the polarity of the toner, the particles being deposited on the non-image section having a greater area. This raises the problem of the suppression effect of carrier deterioration being reduced in the developing apparatus. Further, the hybrid development system disclosed in the Unexamined Japanese Patent Application Publication No. H9-185247 has a problem in that the carrier surface is contaminated by the toner and finishing agent with an increase in the amount of high-volume printing, and the carrier charge-applying property is reduced. In the method disclosed in the Unexamined Japanese Patent Application Publication No. 2002-108104, collection among images becomes difficult when the speed is increased. This requires control in such a way as to increase the space between images (sheets). This raises the problem of productivity being reduced.

An object of the present invention is to provide a developing apparatus using a two-component developer, an image forming apparatus capable of avoiding residual image (memory effect) and stably suppressing the deterioration of the carrier, and a method of forming an image, thereby ensuring long-term formation of a high quality image.

SUMMARY

In view of forgoing, one embodiment according to one aspect of the present invention is a developing apparatus, comprising:

a developer container which is adapted to contain a developer including a toner, a carrier for charging the toner, and opposite polarity particles to be charged opposite to a charge polarity of the toner;

a developer carrying member which is adapted to convey the toner supplied from the developer container;

a toner carrying member which is provided facing the developer carrying member and is adapted to receive the toner from the developer on the developer carrying member and to convey the toner;

a first voltage applying section which is adapted to apply a DC voltage overlapped with an AC voltage to the developer carrying member; and a second voltage applying section which is adapted to apply a DC voltage overlapped with an AC voltage to the toner carrying member.

According to another aspect of the present invention, another embodiment is an image forming apparatus, comprising:

an image carrying member;

an imager forming mechanism which is adapted to form an electrostatic latent image on the image carrying member; and an developing apparatus, the developing apparatus including:

a developer container which is adapted to contain a developer including a toner, a carrier for charging the toner, and opposite polarity particles to be charged opposite to a charge polarity of the toner;

a developer carrying member which is adapted to convey the toner supplied from the developer container;

a toner carrying member which is provided facing the developer carrying member and is adapted to receive the toner from the developer on the developer carrying member and to convey the toner;

a first voltage applying section which is adapted to apply a DC voltage overlapped with an AC voltage to the developer carrying member; and a second voltage applying section which is adapted to apply a DC voltage overlapped with an AC voltage to the toner carrying member, wherein the electrostatic latent image on the image carrying member is developed with the toner conveyed by the toner carrying member.

According to another aspect of the present invention, another embodiment is a method for forming an image, the method comprising the steps of:

supplying a developer carrying member with a developer including a toner, a carrier for charging the toner, and opposite polarity particles to be charged opposite to a charge polarity of the toner;

forming an electric field between the developer carrying member and a toner carrying member by applying a first voltage which is a DC voltage overlapped with an AC voltage to the developer carrying member and applying a second voltage which is a DC voltage overlapped with an AC voltage to the toner carrying member, the toner being transferred from the developer on the developer carrying member to the toner carrying member; and developing the electrostatic latent image on an image carrying member with the toner on the toner carrying member.

DETAILED DESCRIPTION OF THE PREFERRED EMBODIMENT

Figure 1:
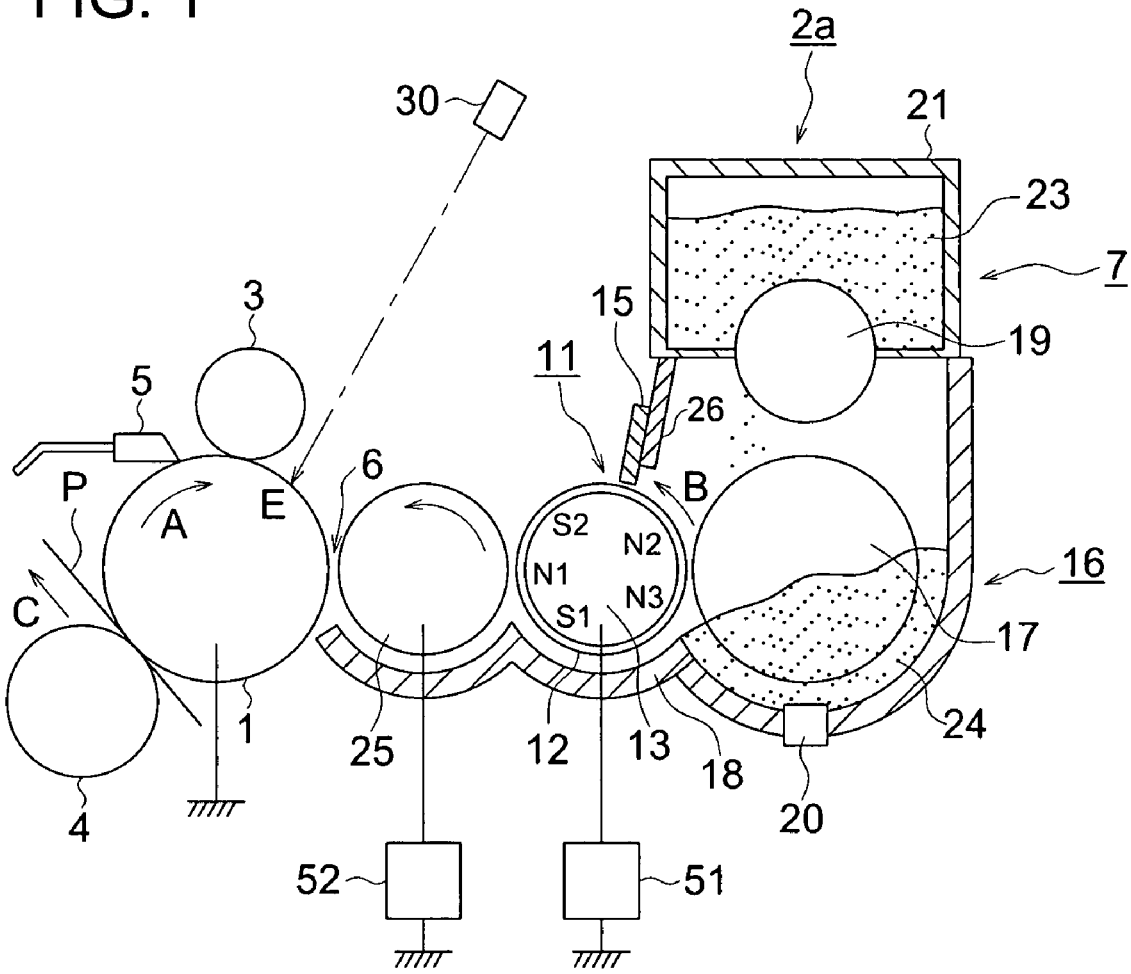
FIG. 1 is a drawing representing the major components of the image forming apparatus as one embodiment of the present invention.

The following describes an embodiment of the present invention with reference to drawings:

FIG. 1 is a drawing representing the major components of the image forming apparatus as one embodiment of the present invention. This image forming apparatus is a printer for transferring the toner image formed on the image carrying member (photoreceptor) 1 by electrophotographic technology onto the transfer medium P such as a sheet, and for forming an image. This image forming apparatus has an image carrying member 1 for carrying an image. A charging member 3 as a charging device for charging the image carrying member 1, a developing apparatus 2*a* for developing the electrostatic latent image on the image carrying member 1, a transfer roller 4 for transferring the toner image on the image carrying member 1, and a cleaning blade 5 for removing the remaining toner on the image carrying member 1 are arranged around the image carrying member 1 sequentially in the rotating direction A of the image carrying member 1.

After having been charged by the charging member 3, the image carrying member 1 is exposed to light at point E in the drawing by the exposure apparatus 30 equipped with a laser beam generator, whereby the electrostatic latent image is formed on the surface. The developing apparatus 2*a* causes this electrostatic latent image to be developed into a toner image. After the toner image on the image carrying member 1 has been transferred onto the transfer medium P, the transfer roller 4 ejects the transfer medium P in the arrow direction marked by C. The cleaning blade 5 uses the mechanical force to remove the remaining toner from the image carrying member 1 having been transferred thereon. Any of conventionally known electrophotographic technologies can be used for the image carrying member 1, charging member 3, exposure apparatus 30, transfer roller 4, cleaning blade 5 and others employed in the image forming apparatus. For example, as the charging device, a charging roller is shown in the drawing, but a charging apparatus which does not contact the image carrying member 1 can be used as such. Further, the cleaning blade need not always be used.

In this embodiment, the developing apparatus 2*a* includes a developer container 16 for storing the developer 24; a developer carrying member 11 for carrying onto the surface the developer 24 supplied from the developer container; and a toner carrying member 25 for separating the toner from the developer on the developer carrying member and carrying the toner. The developer containing opposite polarity particles is used as a developer. This apparatus is provided with a voltage application device for supplying each of the developer carrying member 11 and toner carrying member 25 with the voltage formed by overlapping an AC voltage on a DC voltage.

The developer carrying member 11 is connected to the power source 51 that outputs the voltage formed by overlapping the AC voltage on the DC voltage. The toner carrying member 25 is also connected to the power source 52 for outputting the voltage formed by overlapping the AC voltage on the DC voltage. These power sources are separately installed, and a toner separation electric field formed of the AC field is formed between the developer carrying member 11 and toner carrying member 25. A development electric field formed of the AC field is formed between the toner carrying member 25 and image carrying member 1. The power source 51 and power source 52 serves as a voltage applying section for the developer carrying member 11 and toner carrying member 25. In this case, the image carrying member 1 is connected to the ground.

A predetermined toner separation electric field is formed on the developer carrying member 11 and the toner carrying member 25 by the power sources 51 and 52, whereby the toner in the developer is electrically separated and is carried on the surface of the toner carrying member 25. The toner carried on the toner carrying member 25 is fed to the development area 6 by the rotation of the toner carrying member 25, and the electrostatic latent image on the image carrying member 1 is developed.

When toner is separated from the developer on the developer carrying member 11, a greater portion of the opposite polarity particles remains in the developer on the developer carrying member 11 by electric field formed between the developer carrying member 11 and toner carrying member 25 because of the charging polarity, and is collected into the developer container 16. This arrangement suppresses the consumption of the opposite polarity particles, and permits the opposite polarity particles to effectively make up for the charging performance of the carrier, with the result that carrier deterioration can be suppressed for a long period of time.

The voltage containing the AC component formed on the toner carrying member 25 and developer carrying member 11 should be changed according to the polarity of the charged toner. When the negatively charged toner is used, the voltage having the average value higher than that of the voltages applied to the developer carrying member 11 is applied to the toner carrying member 25. In the meantime, when the positively charged toner is used, the voltage having the average value lower than that of the voltages applied to the developer carrying member 11 is applied to the toner carrying member 25. Independently of whether the toner used is positively or negatively charged, the difference between the average voltage applied to the toner carrying member 25 and that applied to the developer carrying member 11 is preferably in the range of 20 through 500V, more preferably in the range of 50 through 300V in particular. If the potential difference between the developer carrying member 11 and toner carrying member 25 is less than 20 volts, the amount of toner on the toner carrying member 25 will be insufficient, and satisfactory image density cannot be obtained. In the meantime, if the potential difference between the developer carrying member 11 and toner carrying member 25 is over 500 volts, the amount of toner will be excessive and wasted toner consumption will increase.

In the developing apparatus 2*a*, an AC field is formed between the toner carrying member 25 and developer carrying member 11 (supply Nips). When the AC field has been formed, toner makes a back-and-forth motion between the supply Nips so as to separate the opposite polarity particles electrostatically deposited on the toner effectively. Further, when the AC field is formed on the supply Nips, the development pattern on the toner carrying member 25 formed after development in the development area 6 is disturbed at the supply Nip, and toner can then be easily collected by the magnetic brush on the developer carrying member 11. This arrangement removes the memory effect wherein part of the previous development image appears as a residual image at the time of the next development, resulting from the occurrence of the consumption area and non-consumption area on the toner carrying member 25, wherein this memory effect is mentioned as one of the problems with the hybrid development system. The effect of removing the residual image can be enhanced by increasing the amplitude of the AC field formed between the toner carrying member 25 and developer carrying member 11.

Specifically, when AC voltages are applied to the developer carrying member 11 and toner carrying member 25 from mutually independent power sources, the electric field formed on the supply Nip can be set independently of the electric field to be formed on the development Nip (in the development area 6). This allows an electric field of greater amplitude to be formed on the supply Nip. In this case, the oscillation field formed on the supply Nip is preferably the field wherein the difference (supply Epp) between the maximum value and the minimum value of the oscillation field at the closest section between the two is in the range of $7.0\times10^6$ V/m or more without exceeding $10.0\times10^6$ V/m, because generation of memory effect (residual image) can be almost completely avoided. If the electric field in excess of $10.0\times10^6$ V/m is formed, a partial leak tends to occur between supply Nips, and therefore, this is not preferred.

An AC field is also formed between the image carrying member 1 and toner carrying member 25 (development Nip). If DC field alone is formed, the toner on the toner carrying member cannot be completely removed from the toner carrying member; hence sufficient image density cannot be obtained. In this case, the electric field formed on the development Nip is preferably the oscillation field wherein the difference between the maximum value and minimum value (development Epp) of the oscillation field at the closest section of the two is in the range of $6.0\times10^6$ V/m or more without exceeding $9\times10^6$ V/m. This arrangement suppresses ejection of the opposite polarity particles to the image carrying member while maintaining the image density. Even if the images of reduced toner consumption are continuously printed out, reduction in the carrier charge-applying property can be effectively made up for.

The electric field formed on the development Nip is preferably the oscillation field having a frequency of 4 kHz or more without exceeding 10 kHz. Formation of such an electric field suppresses ejection of the opposite polarity particles to the image carrying member while maintaining the image density. Even if the images of reduced toner consumption are continuously printed out, reduction in the carrier charge-applying property can be effectively made up for.

There is no particular restriction to the material of the toner carrying member 25 if the aforementioned voltage can be applied. For example, an aluminum roller provided with surface treatment can be used. Further, the examples include the aluminum conductive substrate coated with resins such as polyester resin, polycarbonate resin, acryl resin, polyethylene resin, polypropylene resin, urethane resin, polyamide resin, polyimide resin, polysulfone resin, polyether ketone resin, vinyl chloride resin, vinyl acetate resin, silicone resin and fluorine resin, or rubbers such as silicone rubber, urethane rubber, nitrile rubber, natural rubber and isoprene rubber. The coating material is not restricted to the aforementioned materials. A conductive agent can be added to the bulk or surface of the aforementioned coating. An electron conductive agent or ion conductive agent can be mentioned as a conductive agent. The electron conductive agent is exemplified by carbon black such as ketchine black, acetylene black and furnace black, and particles such as metal powder and metal oxide. The ion conductive agent is exemplified by a cationic compound such as quaternary ammonium salt, amphoteric compound and other ionic polymer materials, without the material being restricted thereto. Further, a conductive roller made of metallic material such as aluminum can be used.

In the developing apparatus 2*a* shown in FIG. 1, to put it in greater details, the developer 24 in the developer container 16 is mixed and stirred by rotation of the bucket roller 17. After having been subjected to triboelectric charging, the developer is sucked up by the bucket roller 17 and is supplied to the sleeve roller 12 on the surface of the developer carrying member 11. This developer 24 is held on the surface of the sleeve roller 12 by the magnetic force of the magnetic roller 13 inside the developer carrying member (development roller) 11 and is rotated and moved together with the sleeve roller 12. The amount of the developer passing through is regulated by the regulating member 15 arranged face to face with the development roller 11. After that, at the portion placed face to face with the toner carrying member 25, only the toner contained in the developer is separated by the toner carrying member 25 and is carried thereby, as described above. The separated toner is fed to the development area 6 arranged face to face with the image carrying member 1. In the development area 6, the toner on the toner carrying member 25 is moved toward the electrostatic latent image on the image carrying member 1 by the force applied to the toner by the electric field formed between the electrostatic latent image on the image carrying member 1 and the toner carrying member 25 with the development bias applied thereto. Then the electrostatic latent image is developed into a visible image. Development can be performed by reversal development method, or by the normal development method. The toner layer on the toner carrying member 25 having passed through the development area 6 is again conveyed to the development area 6 through the supply and recovery of toner by the magnetic brush on the portion face to face with the toner carrying member 25 and developer carrying member 11. In the meantime, the developer from which toner is separated and which remains on the developer carrying member 11 is directly conveyed to the developer container 16. The developer is separated from the developer carrying member 11 by the repulsion magnetic field of the magnetic roller homopolar portions N3 and N2 arranged face to face with the bucket roller 17, and is collected into the developer container 16. Similarly to the case of FIG. 1, after detecting that the toner density in the developer 24 has reached the level below the minimum toner density required to maintain the image density, the replenishment control section (not illustrated) arranged in the replenishing section 7 sends the drive start signal to the toner replenishment roller 19, and the replenishment toner 23 is supplied into the developer container 16.

The developer carrying member 11 includes a magnetic roller 13 arranged at a fixed position and a freely rotatable sleeve roller 12 containing the magnetic roller 13. The magnetic roller 13 contains five magnetic poles N1, S1, N3, N2 and S2 which are arranged in the rotating direction of the sleeve roller 12. Of these magnetic poles, the main magnetic pole N1 are arranged in the development area 6 face to face with the image carrying member 1. The homopolar portions N3 and N2 that generate the repulsion magnetic field for separating the developer 24 on the sleeve roller 12 are arranged face to face with the inside of the developer container 16.

The developer container 16 is made up of a casing 18. Normally, it incorporates a bucket roller 17 for supplying developer to the developer carrying member 11. The ATDC (Automatic Toner Density Control) sensor 20 for detecting the toner density is preferably arranged face to face with the bucket roller 17 of the casing 18.

The developing apparatus 2*a* normally includes a replenishing section 7 for replenishing the developer container 16 with the volume of the toner to be consumed in the development area 6; and a regulating member (regulating blade) 15 for thinning the developer layer that regulates the amount of developer on the developer carrying member 11. The replenishing section 7 includes a hopper 21 storing a replenishment toner 23, and a replenishment roller 19 for replenishing toner into the developer container 16.

The toner with the opposite polarity particles externally added thereto is preferably used as the replenishment toner 23. Use of the toner with the opposite polarity particles added thereto effectively suppresses the reduction in the charging performance of the carrier that is gradually deteriorated with the lapse of time. The amount of the opposite polarity particles to be added externally in the replenishment toner 23 is preferably in the range of 0.1 through 10.0% by mass with respect to toner, more preferably in the range of 0.5 through 5.0% by mass.

The opposite polarity particles adequately selected according to the polarity of the charged toner are preferably used.

When the toner having negatively charging property is used, particles having positively charging property are preferably used as the opposite polarity particles. For example, it is possible to use the inorganic particles such as strontium titanate, barium titanate and alumina, and the particles made of the thermoplastic or thermosetting resin such as acryl resin, benzoguanamine resin, nylon resin, polyimide resin and polyamide resin. It is also possible to make such arrangements that an agent for giving positively charging property is contained in the resin, or a copolymer of nitrogen containing monomer is formed. Further, surface treatment can be provided in such a way that positively charging property is given to the surface of the particles having negatively charging property, whereby particles having positively charging property are formed.

When the toner having positively charging property is used, particles having negative charging property are preferably used as the opposite polarity particles. For example, it is possible to use particles made of the thermoplastic or thermosetting resin such as fluorine resin, polyolefin resin, silicone resin and polyester resin, in addition to the inorganic particles such as silica and titanium oxide. It is also possible to make such arrangements that an agent for giving negatively charging property is contained in the resin, or a copolymer of fluorine acryl monomer and fluorine-containing methacryl monomer is formed. Further, surface treatment can be provided in such a way that negatively charging property is given to the surface of the particles having positively charting property, whereby negatively charged particles are formed.

To control the polarity and hydrophobicity of the opposite polarity particles, the surface of the inorganic particles can be provided with surface treatment using a silane coupling agent, titanium coupling agent and silicone oil. Specifically, in order to give the inorganic particles positively charging property, an amino group-containing coupling agent is preferably used for surface treatment. In order to give the particles negatively charging property, a fluorine group-containing coupling agent is preferably used for surface treatment.

The number average particle diameter of the opposite polarity particles is preferably in the range of 100 through 1000 nm.

There is no particular restriction to the material of toner. It is also possible to use the conventionally known toner which is commonly in use. According to the coloring agent or, when necessary, a charge regulating agent or mold releasing agent can be contained in the binder resin, or the toner can be treated with an external additive agent. The toner particle diameter is preferably in the range of 3 through 15 μm, without being restricted thereto.

Such toner can be prepared according to the conventionally known method that is commonly employed. It can be prepared using the pulverization method, emulsion polymerization method, or suspension polymerization method.

There is no particular restriction to the binder resin used for toner. The examples include a styrene resin (homopolymer or copolymer including styrene or substituted styrene), polyester resin, epoxy resin, vinyl chloride resin, phenol resin, polyethylene resin, polypropylene resin, polyurethane resin and silicone resin. These resins having a softening temperature in the range of 80 through 160° C. and a glass transition point in the range of 50 through 75° C. can be used independently or in combination.

A conventionally known coloring agent that is commonly employed can be used as the coloring agent. The examples include carbon black, aniline black, activated carbon, magnetite, benzine yellow, permanent yellow, naphthol yellow, phthalocyanine blue, first sky blue, ultra marine blue, rose bengal, and lake red. Generally, 2 through 20 parts by mass of coloring agent is preferably used with respect to 100 parts by mass of the aforementioned binder resin.

A conventionally known agent can be used as the aforementioned charge regulating agent. The charge regulating agent for toner having positively charging property is exemplified by nigrosine dye, quaternary ammonium salt compound, triphenyl methane compound, imidazole compound and polyamine resin. The charge regulating agent for toner having negatively charging property is exemplified by a metal-containing azo dye such as Cr, Co, Al and Fe, salicylic acid metal compound, alkyl salicylic acid metal compound, and Kerlix arene compound. Generally, the charge regulating agent is preferably used in the range of 0.1 through 10 parts by mass with respect to 100 parts by mass of the aforementioned binder resin.

A conventionally known agent that is commonly used can be employed as the aforementioned mold releasing agent. Polyethylene, polypropylene, carnauba wax and sazol wax can be used independently or in combination. Generally, the mold releasing agent is preferably used in the range of 0.1 through 10 parts by mass with respect to 100 parts by mass of the aforementioned binder resin.

Further, a conventionally known agent that is commonly used can be employed as the aforementioned external additive agent. For plasticity improvement, inorganic particles such as silica, titanium oxide and aluminum oxide, and resin particles such as acryl resin, styrene resin, silicone resin and, fluorine resin can be used. The agent hydrophobed with silane coupling agent, titanium coupling agent and silicone oil is preferably used in particular. Such a plasticizer is preferably added in the range of 0.1 through 5 parts by mass with respect to 100 parts by mass of the aforementioned toner. The number average primary particle diameter of the external additive agent is preferably in the range of 10 through 100 nm.

There is no particular restriction to the material of the carrier. It is possible to use the conventionally known carrier that is commonly employed. A binder carrier and coating type carrier can be utilized. The carrier particle diameter is preferably in the range of 15 through 100 μm, without being restricted thereto.

The binder carrier is made of the magnetic particles dispersed in the binder resin. Particles having positively or negatively charging property can be deposited onto the carrier surface, or a surface coating layer can be provided. The charging property of the binder carrier polarity can be controlled according to the material of the binder resin and types of the electrostatic particles and surface coating layer.

The binder resin utilized in the binder carrier can be exemplified by a thermoplastic resin such as vinyl resin represented by a polystyrene resin, polyester resin, nylon resin and polyolefin resin; and a thermosetting resin such as phenol resin.

Following materials can be used as the magnetic particle of the binder carrier: magnetite; spinel ferrite such as gamma iron oxide; spinel ferrite containing one or more than one metal other than iron (e.g., Mn, Ni, Mg, Cu); magnetoplumbite-type ferrite such as spinel ferrite and barium ferrite; and particles of iron or alloy having an oxide layer on the surface. It can be granular, spherical or acicular. When high-level magnetization is required, iron-based ferromagnetic particles are preferably used. When chemical stability is taken into account, the ferromagnetic particles of magnetite, spinel ferrite including gamma iron oxide or magnetoplumbite-type ferrite such as barium ferrite are preferably used. The magnetic resin carrier having a desired level of magnetization can be obtained by proper selection of the type of the ferromagnetic particle and the amount contained. The amount of the magnetic particle to be added to the magnetic resin carrier is preferably in the range of 50 through 90% by mass.

Silicone resin, acryl resin, epoxy resin and fluorine resin are used as the surface coating materials of the binder carrier. The surface is coated with these resins and is hardened to form a coating layer, whereby the performance of applying electric charge to toner is enhanced.

Deposition of the electrostatic particles or conductive particles onto the surface of the binder carrier is achieved by the step of uniform mixing of the magnetic resin carrier and particles and the step of giving mechanical and thermal impact after these particles have been deposited onto the surface of the magnetic resin carrier in order to drive particles into the magnetic resin carrier. In this case, the particles are not completely buried in the magnetic resin carrier. The particles are deposited in such a way that they are partly protruded from the surface of the magnetic resin carrier. Organic or inorganic insulating materials is used as electrostatic particles. To put it more specifically, the organic materials are exemplified by organic insulating particles of polystyrene, styrene copolymer, acryl resin, various forms of acryl copolymer, nylon, polyethylene, polypropylene, fluorine resin and the crosslinked substance thereof. A desired level of charge and polarity can be obtained by the material, polymerization catalyst and surface treatment. The inorganic material is exemplified by inorganic particles having negatively charging property such as silica, dititanium oxide and others, and inorganic particles having positively charging property such as strontium titanate, alumina and others.

The coating type carrier is prepared by coating resin to the carrier core particle made up of a magnetic member. Similarly to the case of the binder carrier, the coating type carrier is formed by deposition of the particles having positively or negatively charging property onto the surface of the carrier. The charge property of the coating type carrier such as polarity can be regulated according to the type of the surface coating layer and the electrostatic particles. The same material as that of the binder carrier can be utilized. The coating resin in particular can be the same as the binder resin of the binder carrier.

Figure 2:
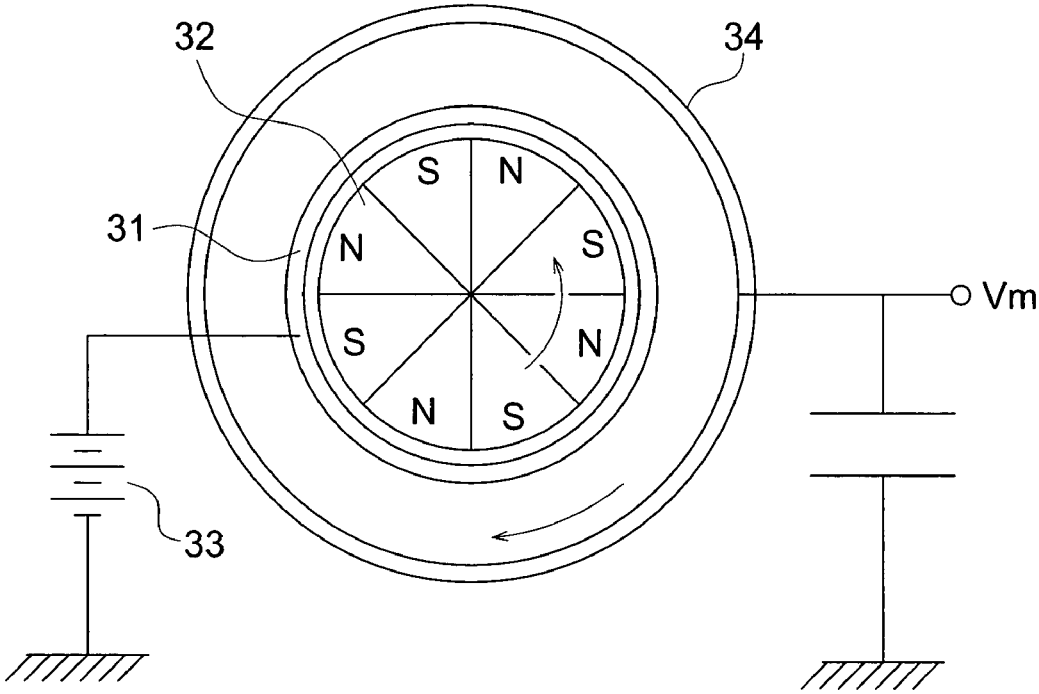
FIG. 2 is a schematic view of the apparatus for measuring the amount of electrostatic charge of the charged particles.

The charging polarity of the toner and opposite polarity particles achieved by combination of the opposite polarity particles, toner and carrier can be easily identified from the direction of the electric field when toner or opposite polarity particles are separated from the developer using the apparatus of FIG. 2 after they have been made into a developer by mixing and stirring. FIG. 2 is a schematic view of the apparatus for measuring the amount of electrostatic charge of the charged particles such as toner.

To be more specific, in the apparatus of FIG. 2, the developer made up of toner, carrier and opposite polarity particles is placed uniformly over the entire surface of the conductive sleeve 31. The speed of the magnetic roll 32 arranged inside this conductive sleeve 31 is set to 1000 rpm, and a 2 kV bias voltage is applied by the bias power source 33 to give the same polarity as the charging potential of the toner. The aforementioned conductive sleeve 31 is rotated for 15 seconds. When this conductive sleeve 31 has been stopped, the potential Vm in the cylindrical electrode 34 is read, and the mass of the toner deposited on the cylindrical electrode 34 is weighed by a precision balance, whereby the amount of electrostatic charge of toner can be obtained.

Further, the polarity of the particles to be added except for the toner and carrier can be identified from the polarity of the bias voltage applied from the bias power source 33. To be more specific, when the bias voltage is applied from the bias power source 33 to give the polarity opposite to that of the charging potential of toner, the particles deposited on the cylindrical electrode 34 have the polarity opposite to the charging polarity of toner, namely, they are the opposite polarity particles.

The mixture ratio of toner and carrier is only required to be adjusted to get a desired amount of electrostatic charge of the toner. The toner ratio is in the range of 3 through 50% by mass with respect to the total of the toner and carrier, preferably in the range of 5 through 20% by mass, although it depends on the surface area ratio resulting from the difference in the particle sizes of the toner and carrier.

There is no particular restriction to the amount of the opposite polarity particles included in the developer as long as an object of the present invention is achieved. For example, it is preferably in the range of 0.01 through 5.00 parts by mass with respect to 100 parts by mass of carrier, more preferably in the range of 0.01 through 2.00 parts by mass.

The developer can be prepared by externally adding the opposite polarity particles in advance and mixing them with the carrier thereafter.

In the present embodiment, the oscillation fields formed between the developer carrying member and the toner carrying member and between the toner carrying member and the image carrying member can be set to proper values independently of each other. This makes it possible to reduce the residual image (memory effect) that may occur between the developer carrying member and toner carrying member, and to suppress ejection of the opposite polarity particles to the image carrying member that may occur between the toner carrying member and the image carrying member. This arrangement provides a developing apparatus and an image forming apparatus that ensures stable suppression of carrier deterioration and a long-term formation of a high quality image.

EXAMPLE

The following describes the Example of using the developing apparatus and image forming apparatus in this embodiment.

The developer under the following conditions was used. The coating type carrier having a volume average particle diameter of 33 μm formed by coating the ferrite core with resin was used as the carrier. The toner used was prepared by the following method. 0.6 parts by mass of hydrophobic silica having a number average primary particle diameter of 20 nm provided with surface treatment by the hexamethyl disilazane (HMDS)—a hydrophobing agent as the external additive agent a—; and 0.5 parts by mass of hydrophobic titanium oxide obtained by surface treatment of the anatase type titanium oxide having a number average primary particle diameter of 30 nm by isobutyl trimethoxy silane as a hydrophobing agent in the aqueous wet system—as the external additive agent b—were externally added to 100 parts by mass of the black toner base material having a volume average particle diameter of about 6.5 μm manufactured by the wet pelletization method at a speed of 40 m/s for two minutes using the Henschel mixer (by Mitsui Mining and Smelting Co., Ltd.). Further, the strontium titanate having a number average particle diameter of 350 nm as the opposite polarity particles was externally added to the toner provided with external addition, at a speed of 40 m/s for twenty minutes using a Henschel mixer wherein the ratio was 2 parts by mass with respect to 100 parts by mass of toner base material. In this case, the ratio of toner in the developer was 8% by mass. However, the ratio of toner was represented in terms of the ratio of the total amount of the toner, finishing agent and opposite polarity particles, with respect to the total amount of developer.

The aluminum roller provided with alumite treatment on the surface was used as the toner carrying member. Further, the potential on the background section of the electrostatic latent image formed on the image carrying member was −550 V, and the potential on the image section was −60 V.

Example 1 Through 19

Figure 3:
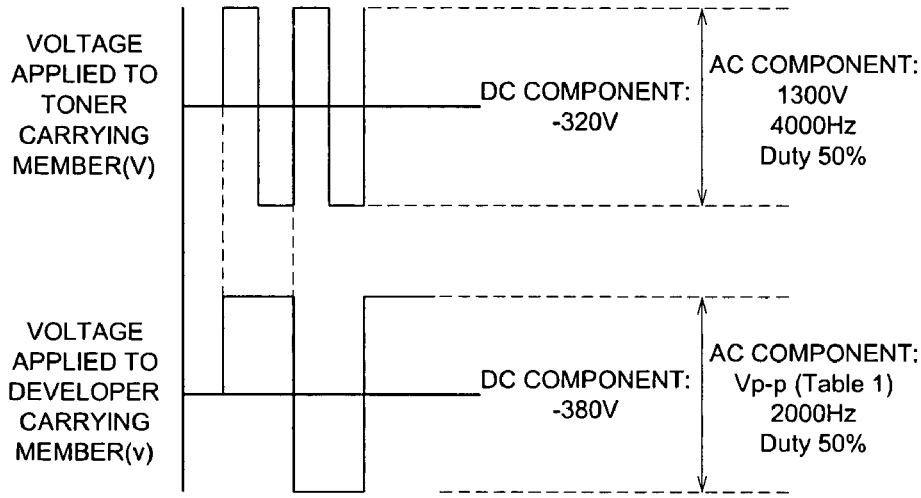
FIG. 3 is a diagram showing the waveform and timing of the voltage applied in the Example.
Figure 4:
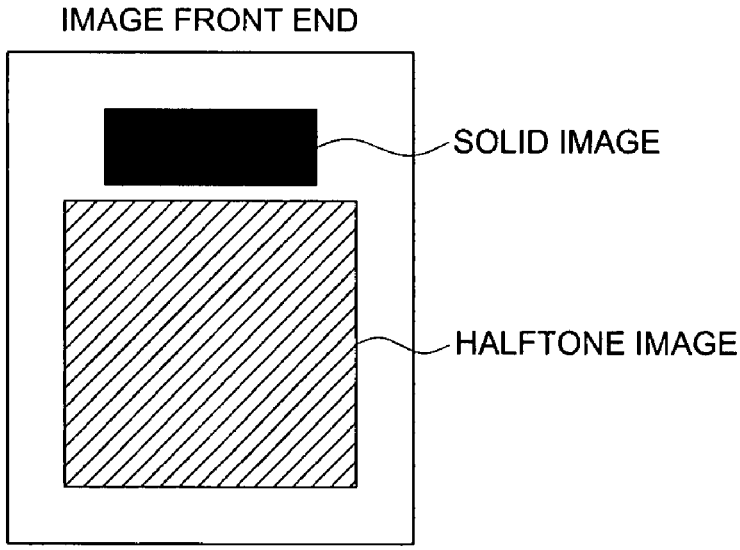
FIG. 4 is a diagram showing the output image for checking the generation of memory effect.
Figure 5:
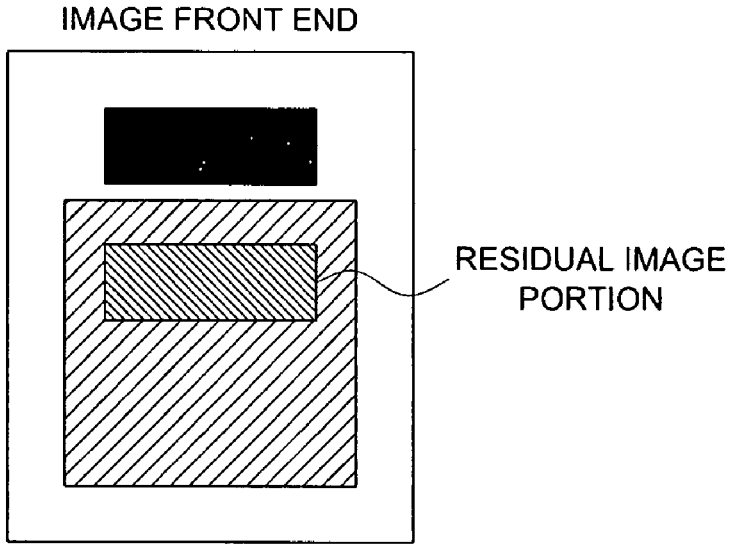
FIG. 5 is a diagram showing the image with memory effect.

In the Example 1 through 19, the voltage of rectangular wave was applied to the toner carrying member, wherein the DC component was −320V, and the AC component had a voltage Vp-p of 1.3 kV with a peak-to-peak amplitude, a frequency of 4000 Hz and a duty ratio of 50%. The distance (Ds) was 150 μm at the closest section wherein the toner carrying member and image carrying member were placed face to face with each other. The voltage of rectangular wave was applied to the developer carrying member wherein the DC component was −380V, and the AC component had a voltage Vp-p shown in Table 1 a peak-to-peak amplitude, a duty ratio of 50% and a frequency of 2000 Hz. The peak-to-peak value of the oscillation voltage related to the supply Nip (potential of toner carrying member—potential of developer carrying member) in this case was equal to the supply voltage Vpp shown in Table 1. The distance (Dss) was 300 μm at the closest section wherein the developer carrying member and the toner carrying member were placed face to face with each other. The difference in the maximum value and minimum value of the electric field at the closest section between the toner carrying member and image carrying member is obtained from the supply voltage Vpp/Dss. It is equal to the supply Epp of Table 1. FIG. 3 shows the waveform and timing of the voltage applied in the Example. To be more specific, the voltage applied to the toner carrying member with a frequency of 4000 Hz and the voltage applied to the developer carrying member with a frequency of 2000 Hz are synchronized in such a way that the rise of the one is timed with the rise of the other. Under this condition, the image shown in FIG. 4 was outputted, and the generation of the memory effect (residual image), the density of the solid image portion, and generation of the black point due to leakage were checked. When the memory effect occurs, the residual image of the solid image is verified in the halftone image shown in FIG. 5. The amount of toner charge in the initial phase was compared with the amount of toner charge at the time of printing the 100,000th sheet after high-volume printing of up to 100,000 sheets with an image ratio of 5% under the aforementioned condition.

Comparative Example 1 Through 3

In the Comparative examples 1 through 3, the voltage was applied to the toner carrying member, and the developer carrying member. In this case, the DC component was applied to either of them and both of them. Thus, the voltage was applied as shown in Table 1. Otherwise, the same procedure as that of the Example 1 was used for evaluation.

Table 1 shows the results of evaluation in Examples 1 through 19 and Comparative examples 1 through 3.

The memory effect (residual image) in the Table was evaluated as follows: The 310TR manufactured by X-Rite was used to measure the reflection density at the position wherein a residual image occurred in the halftone image, and other positions in the halftone image. Thus, A" is assigned when the difference in both measurements is 0.1 or less; "B" is assigned when the difference is in the range of 0.1 through 0.3, and "C" is assigned when the difference is greater than 0.3. If this difference is about 0.1 or less, the memory effect is not visible. Further, when it is 0.1 through 0.3, the memory effect is slightly visible, but the level is permissible. When this is greater than 0.3, the image quality is not acceptable. Further, "A" is assigned when the reflection density of the solid image is 1.2 or more; "B" is assigned when the reflection density is less than 1.2; and "C" is assigned when the reflection density is 1.0 or less. Leakage was evaluated as follows: "A" is assigned when no noise is identified by visual observation. "B" is assigned when a black spot is identified. "C" is assigned when there is a problem in image quality. Further, the fluctuation in the charge amount of toner was evaluated as follows: "A" is assigned when the fluctuation is 0 through 1 μC; "B" is assigned when the fluctuation is greater than 1 μC without exceeding 5 μC; and "C" is assigned when the fluctuation is greater than 5 μC.

TABLE 1

| | Voltage applied to toner carrying member | | | Voltage applied to developer carrying member | | | Supply | Supply | Supply | | | | Charge amount of toner | | |
|---|---|---|---|---|---|---|---|---|---|---|---|---|---|---|---|
| | DC (V) | Vp-p (V) | Frequency (Hz) | DC (V) | Vp-p (V) | Frequency (Hz) | Vpp (V) | Nip (μm) | Epp (V/μm) | Image density | Memory effect | Leakage | Initial | *1 | *2 |
| **1 | −320 | 1300 | 4000 | −380 | 100 | 2000 | 1400 | 300 | 4.7 | A | B | A | 23.1 | 23.3 | A |
| **2 | −320 | 1300 | 4000 | −380 | 200 | 2000 | 1500 | 300 | 5.0 | A | B | A | 23.4 | 23.4 | A |
| **3 | −320 | 1300 | 4000 | −380 | 300 | 2000 | 1600 | 300 | 5.3 | A | B | A | 23.1 | 22.4 | A |
| **4 | −320 | 1300 | 4000 | −380 | 400 | 2000 | 1700 | 300 | 5.7 | A | B | A | 23.2 | 22.8 | A |
| **5 | −320 | 1300 | 4000 | −380 | 500 | 2000 | 1800 | 300 | 6.0 | A | B | A | 23.3 | 22.5 | A |
| **6 | −320 | 1300 | 4000 | −380 | 600 | 2000 | 1900 | 300 | 6.3 | A | B | A | 23.0 | 23.0 | A |
| **7 | −320 | 1300 | 4000 | −380 | 700 | 2000 | 2000 | 300 | 6.7 | A | B | A | 23.1 | 23.5 | A |
| **8 | −320 | 1300 | 4000 | −380 | 800 | 2000 | 2100 | 300 | 7.0 | A | A | A | 23.3 | 22.9 | A |
| **9 | −320 | 1300 | 4000 | −380 | 900 | 2000 | 2200 | 300 | 7.3 | A | A | A | 23.1 | 23.6 | A |
| **10 | −320 | 1300 | 4000 | −380 | 1000 | 2000 | 2300 | 300 | 7.7 | A | A | A | 23.0 | 23.0 | A |
| **11 | −320 | 1300 | 4000 | −380 | 1100 | 2000 | 2400 | 300 | 8.0 | A | A | A | 23.3 | 23.6 | A |
| **12 | −320 | 1300 | 4000 | −380 | 1200 | 2000 | 2500 | 300 | 8.3 | A | A | A | 23.4 | 22.4 | A |
| **13 | −320 | 1300 | 4000 | −380 | 1300 | 2000 | 2600 | 300 | 8.7 | A | A | A | 23.0 | 23.1 | A |
| **14 | −320 | 1300 | 4000 | −380 | 1400 | 2000 | 2700 | 300 | 9.0 | A | A | A | 23.1 | 23.0 | A |
| **15 | −320 | 1300 | 4000 | −380 | 1500 | 2000 | 2800 | 300 | 9.3 | A | A | A | 23.4 | 23.5 | A |
| **16 | −320 | 1300 | 4000 | −380 | 1600 | 2000 | 2900 | 300 | 9.7 | A | A | A | 23.1 | 23.2 | A |
| **17 | −320 | 1300 | 4000 | −380 | 1700 | 2000 | 3000 | 300 | 10.0 | A | A | A | 23.2 | 23.3 | A |
| **18 | −320 | 1300 | 4000 | −380 | 1800 | 2000 | 3100 | 300 | 10.3 | A | A | B | 23.1 | 23.4 | A |
| **19 | −320 | 1300 | 4000 | −380 | 1900 | 2000 | 3200 | 300 | 10.7 | A | A | B | 23.3 | 23.2 | A |
| Comp. 1 | −320 | — | — | −380 | — | — | — | 300 | — | C | — | A | 23.1 | 15.7 | C |

TABLE 1-continued

| | Voltage applied to toner carrying member | | | Voltage applied to developer carrying member | | | Supply | Supply | Supply | | | | Charge amount of toner | | |
|---|---|---|---|---|---|---|---|---|---|---|---|---|---|---|---|
| | DC (V) | Vp-p (V) | Frequency (Hz) | DC (V) | Vp-p (V) | Frequency (Hz) | Vpp (V) | Nip (μm) | Epp (V/μm) | Image density | Memory effect | Leak-age | Initial | *1 | *2 |
| Comp. 2 | −320 | 1300 | 4000 | −380 | — | — | 1300 | 300 | 4.3 | A | C | A | 23.2 | 16.3 | C |
| Comp. 3 | −320 | — | — | −380 | 1400 | 2000 | 1400 | 300 | 4.7 | C | — | A | 23.0 | 18.5 | C |

**Example, Comp.: Comparative example,
*1: 100,000th sheet,
*2: Charge maintenance In the Table, the supply Epp shows the difference between the maximum value and minimum value of the oscillation field in the supply Nip. As is apparent, the voltage formed by overlapping an AC voltage to a DC voltage is applied to each of the developer carrying member and toner carrying member. A toner separation field made up of the AC field is formed between the developer carrying member and toner carrying member. The development electric field made of AC field is formed between the toner carrying member and image carrying member. Thus, it can be seen that a stable amount of toner charge free from memory effect being produced, hence long-term maintenance of the high quality image can be ensured. Specifically, when the supply Epp is $7\times10^6$ V/m or more without exceeding $10\times10^6$ V/m, satisfactory results without memory effect or leakage. Further, no reduction in the charge amount was observed at the time of 100,000th sheet. This demonstrates that there is no carrier deterioration resulting from long-term use.

Example 20 and Comparative Examples 4 and 5

In Example 20, the rectangular wave voltage with a DC component of −380V at a duty ratio 50% and frequency of 4000 Hz was applied to the developer carrying member in such a way that the supply voltage Vpp at the supply Nip would be 2400V. Otherwise, the same developing apparatus, image forming apparatus, and developer as those of Example 1 were used. In this case, the supply Epp was $8.0\times10^6$ V/m.

In the Comparative example 4, the same apparatuses and developer as those of the Example 20 were used, except that strontium titanate as the opposite polarity particles was not used.

Figure 6:
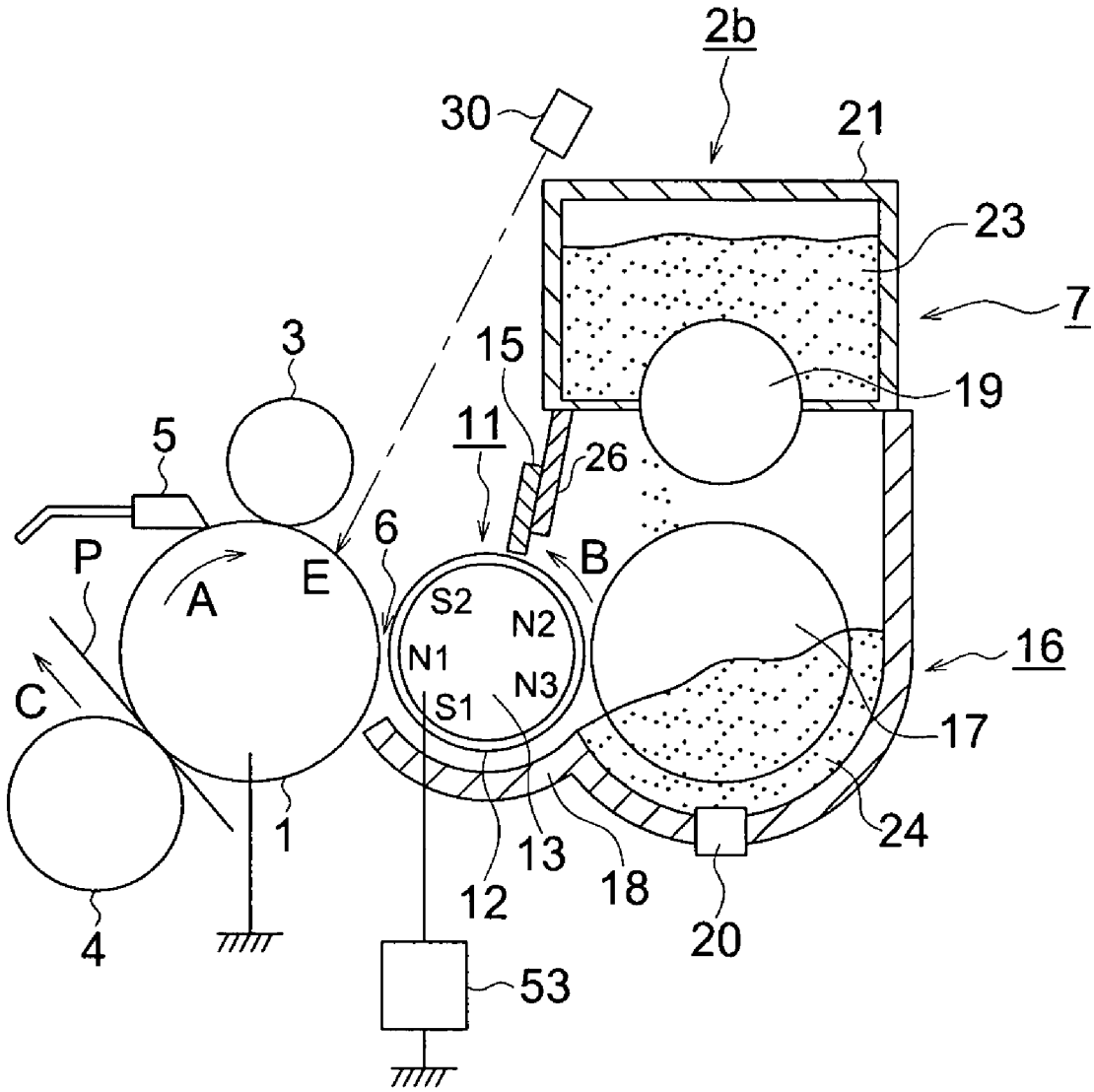
FIG. 6 is a diagram showing the developing apparatus of Comparative example 5.

In the Comparative example 5, the development device based on the two-component development system shown in FIG. 6 was utilized. The voltage formed by overlapping a DC −420V on the AC bias of the rectangular wave having a frequency of 4000 Hz, a voltage Vp-p of 1400 V and a duty ratio of 50% was applied to the developer carrying member from the power source 53. In this case, the surface potential of the image carrying member was −550 V, and the potential of the image portion was −50 V. The gap on the closest section between the developer carrying member surface and image carrying member surface was 350 μm. Otherwise, the same apparatuses and developer as those of Example 20 were used.

Example 20 and Comparative examples 4 and 5 were evaluated according to the same procedure as that of Example 1.

Table 2 shows the result.

TABLE 2

| | Voltage applied to toner carrying member | | | Voltage applied to developer carrying member | | | Supply | Supply | Supply | | | | Charge amount of toner | | |
|---|---|---|---|---|---|---|---|---|---|---|---|---|---|---|---|
| | DC (V) | Vp-p (V) | Frequency (Hz) | DC (V) | Vp-p (V) | Frequency (Hz) | Vpp (V) | Nip (μm) | Epp (V/μm) | Image density | Memory effect | Leak-age | Initial | *1 | *2 |
| **20 | −320 | 1300 | 4000 | −380 | 1100 | 4000 | 2400 | 300 | 8.0 | A | A | A | 23.1 | 23.5 | A |
| Comp. 4 | −320 | 1300 | 4000 | −380 | 1100 | 4000 | 2400 | 300 | 8.0 | A | A | A | 23.5 | 14.2 | C |
| Comp. 5 | — | — | — | −420 | 1400 | 4000 | — | — | — | A | A | A | 23.6 | 14.6 | C |

**Example, Comp.: Comparative example,
*1: 100,000th sheet,
*2: Charge maintenance As is clear from Table 2, in Example 20, no reduction in the amount of toner charge was observed. The charge compensation effect of the opposite polarity particles can be verified in the structure of the present embodiment. It has also been demonstrated that this structure suppresses the reduction in the charge amount resulting from carrier deterioration having occurred in the structure of Comparative example 5.

Examples 21 Through 35

In Examples 21 through 35, a bias of the rectangular wave having a DC component of −320 V, a duty ratio of 50%, a frequency of 4000 Hz and a peak-to-peak amplitude (development Vpp) shown in Table 3 was applied to the toner carrying member, and a rectangular wave having a DC component of −380 V, a duty ratio of 50%, a frequency of 2000 Hz and a supply voltage Vpp of 2400 V at the supply Nip was applied to the developer carrying member. Otherwise, the same developing apparatus, image forming apparatus and developer as those of Example 1 were used. The distance (Dss) was 300 μm at the closest section wherein the developer carrying member and toner carrying member were placed face to face with each other. The supply Epp in this case was $8.0\times10^6$ V/m.

Examples 21 through 35 were evaluated according to the same procedure as that of Example 1.

Table 3 shows the result.

TABLE 3

| | Voltage applied to toner carrying member | | | Voltage applied to developer carrying member | | | Supply | Development | Development | | | | Charge amount of toner | | |
|---|---|---|---|---|---|---|---|---|---|---|---|---|---|---|---|
| | DC (V) | Vp-p (V) | Frequency (Hz) | DC (V) | Vp-p (V) | Frequency (Hz) | Vpp (V) | Nip (μm) | Epp (V/μm) | Image density | Memory effect | Leakage | Initial | *1 | *2 |
| **21 | −320 | 750 | 4000 | −380 | 1650 | 2000 | 2400 | 150 | 5.0 | B | A | A | 23.2 | 23.3 | A |
| **22 | −320 | 800 | 4000 | −380 | 1600 | 2000 | 2400 | 150 | 5.3 | B | A | A | 23.3 | 23.0 | A |
| **23 | −320 | 850 | 4000 | −380 | 1550 | 2000 | 2400 | 150 | 5.7 | B | A | A | 23.0 | 23.5 | A |
| **24 | −320 | 900 | 4000 | −380 | 1500 | 2000 | 2400 | 150 | 6.0 | A | A | A | 23.1 | 22.9 | A |
| **25 | −320 | 950 | 4000 | −380 | 1450 | 2000 | 2400 | 150 | 6.3 | A | A | A | 23.2 | 23.6 | A |
| **26 | −320 | 1000 | 4000 | −380 | 1400 | 2000 | 2400 | 150 | 6.7 | A | A | A | 23.1 | 22.5 | A |
| **27 | −320 | 1050 | 4000 | −380 | 1350 | 2000 | 2400 | 150 | 7.0 | A | A | A | 23.2 | 23.0 | A |
| **28 | −320 | 1100 | 4000 | −380 | 1300 | 2000 | 2400 | 150 | 7.3 | A | A | A | 23.3 | 23.5 | A |
| **29 | −320 | 1150 | 4000 | −380 | 1250 | 2000 | 2400 | 150 | 7.7 | A | A | A | 23.0 | 23.0 | A |
| **30 | −320 | 1200 | 4000 | −380 | 1200 | 2000 | 2400 | 150 | 8.0 | A | A | A | 23.1 | 23.3 | A |
| **31 | −320 | 1250 | 4000 | −380 | 1150 | 2000 | 2400 | 150 | 8.3 | A | A | A | 23.3 | 23.0 | A |
| **32 | −320 | 1300 | 4000 | −380 | 1100 | 2000 | 2400 | 150 | 8.7 | A | A | A | 23.1 | 23.5 | A |
| **33 | −320 | 1350 | 4000 | −380 | 1050 | 2000 | 2400 | 150 | 9.0 | A | A | A | 23.0 | 23.2 | A |
| **34 | −320 | 1400 | 4000 | −380 | 1000 | 2000 | 2400 | 150 | 9.3 | A | A | A | 23.3 | 20.4 | B |
| **35 | −320 | 1450 | 4000 | −380 | 950 | 2000 | 2400 | 150 | 9.7 | A | A | A | 23.4 | 19.0 | B |

**Example, Comp.: Comparative example,
*1: 100,000th sheet,
*2: Charge maintenance The development Epp in the Table indicates the difference between the maximum value and the minimum value of the oscillation field in the development Nip. As will be apparent, the development field formed between the toner carrying member and the image carrying member is preferred to be such that the difference between the maximum value and the minimum value in the electric field at the closest section between the toner carrying member and image carrying member is in the range of $6\times10^6$ V/m or more without exceeding $9\times10^6$ V/m. If the development Epp is below $6.0\times10^6$ V/m, there will be a decrease the amount of the toner cloud generated as a result of oscillation of toner at the development Nip. Then the toner on the toner carrying member will fail to ensure sufficient development of the electrostatic latent image on the image carrying member, with the result that the image density is reduced. In the meantime, if the development Epp exceeds $9\times10^6$ V/m, there will be in increase in the ejection of the opposite polarity particles in the development area. This will tend to reduce the density of the opposite polarity particles in the developer, with the result that the suppression effect of carrier deterioration of the opposite polarity particles is reduced. Thus, the toner charging ability of the carrier is considered to be reduced when the 100,000th sheet has been printed. It should be noted that no memory effect (residual image) occurred in any of the present Examples.

Examples 36 Through 56

In Examples 36 through 56, the bias of the rectangular wave with a DC component of −320 V, a duty ratio of 50%, a development voltage Vpp of 1300 V and a frequency of Table 4 was applied to the toner carrying member. The rectangular wave voltage having a DC component of −380V, a duty ratio of 50%, and the frequency of Table 4 was applied to the developer carrying member so that the supply voltage Vpp at the supply Nip would be 2400 V. Otherwise, the same developing apparatus, image forming apparatus and developer as those of Example 1 were used. The distance (Dss) was 300 μm at the closest section wherein the developer carrying member and toner carrying member were placed face to face with each other. The supply Epp in this case was $8.0\times10^6$ V/m.

Examples 36 through 56 were evaluated according to the same procedure as that of Example 1.

Table 4 shows the result.

TABLE 4

| | Voltage applied to toner carrying member | | | Voltage applied to developer carrying member | | | Supply | Development | Development | | | | Charge amount of toner | | |
|---|---|---|---|---|---|---|---|---|---|---|---|---|---|---|---|
| | DC (V) | Vp-p (V) | Frequency (Hz) | DC (V) | Vp-p (V) | Frequency (Hz) | Vpp (V) | Nip (μm) | Epp (V/μm) | Image density | Memory effect | Leakage | Initial | *1 | *2 |
| **36 | −320 | 1300 | 1000 | −380 | 1100 | 500 | 2400 | 150 | 8.7 | A | A | A | 23.0 | 18.3 | B |
| **37 | −320 | 1300 | 1500 | −380 | 1100 | 500 | 2400 | 150 | 8.7 | A | A | A | 23.1 | 19.0 | B |
| **38 | −320 | 1300 | 2000 | −380 | 1100 | 500 | 2400 | 150 | 8.7 | A | A | A | 23.3 | 19.0 | B |
| **39 | −320 | 1300 | 2500 | −380 | 1100 | 500 | 2400 | 150 | 8.7 | A | A | A | 23.1 | 19.2 | B |
| **40 | −320 | 1300 | 3000 | −380 | 1100 | 500 | 2400 | 150 | 8.7 | A | A | A | 23.0 | 19.7 | B |
| **41 | −320 | 1300 | 3500 | −380 | 1100 | 500 | 2400 | 150 | 8.7 | A | A | A | 23.3 | 21.6 | B |
| **42 | −320 | 1300 | 4000 | −380 | 1100 | 500 | 2400 | 150 | 8.7 | A | A | A | 23.4 | 23.0 | A |
| **43 | −320 | 1300 | 4500 | −380 | 1100 | 500 | 2400 | 150 | 8.7 | A | A | A | 23.1 | 23.0 | A |
| **44 | −320 | 1300 | 5000 | −380 | 1100 | 500 | 2400 | 150 | 8.7 | A | A | A | 23.0 | 23.0 | A |
| **45 | −320 | 1300 | 5500 | −380 | 1100 | 500 | 2400 | 150 | 8.7 | A | A | A | 23.3 | 23.0 | A |
| **46 | −320 | 1300 | 6000 | −380 | 1100 | 500 | 2400 | 150 | 8.7 | A | A | A | 23.4 | 23.0 | A |
| **47 | −320 | 1300 | 6500 | −380 | 1100 | 500 | 2400 | 150 | 8.7 | A | A | A | 23.0 | 23.0 | A |
| **48 | −320 | 1300 | 7000 | −380 | 1100 | 500 | 2400 | 150 | 8.7 | A | A | A | 23.2 | 23.0 | A |
| **49 | −320 | 1300 | 7500 | −380 | 1100 | 500 | 2400 | 150 | 8.7 | A | A | A | 23.3 | 23.0 | A |
| **50 | −320 | 1300 | 8000 | −380 | 1100 | 500 | 2400 | 150 | 8.7 | A | A | A | 23.0 | 23.0 | A |
| **51 | −320 | 1300 | 8500 | −380 | 1100 | 500 | 2400 | 150 | 8.7 | A | A | A | 23.0 | 23.0 | A |
| **52 | −320 | 1300 | 9000 | −380 | 1100 | 500 | 2400 | 150 | 8.7 | A | A | A | 23.3 | 23.0 | A |
| **53 | −320 | 1300 | 9500 | −380 | 1100 | 500 | 2400 | 150 | 8.7 | A | A | A | 23.4 | 23.0 | A |
| **54 | −320 | 1300 | 10000 | −380 | 1100 | 500 | 2400 | 150 | 8.7 | A | A | A | 23.4 | 23.0 | A |
| **55 | −320 | 1300 | 10500 | −380 | 1100 | 500 | 2400 | 150 | 8.7 | B | A | A | 23.3 | 23.0 | A |
| **56 | −320 | 1300 | 11000 | −380 | 1100 | 500 | 2400 | 150 | 8.7 | B | A | A | 23.0 | 23.0 | A |

**Example, Comp.: Comparative example,
*1: 100,000th sheet,
*2: Charge maintenance As is clear from the result shown in Table 4, if the frequency of the toner carrying member has exceeded 10000 Hz, toner will fail to follow the electric field, and there will be a reduction in the amount of the toner cloud generated at the development Nip. The toner on the toner carrying member will fail to develop sufficiently on the image carrying member. This is considered to reduce the image density. In the meantime, if the frequency is reduced below 4000 Hz, there will be an increased in ejection of opposite polarity particles in the development area. This will lead to a reduction of the density of the opposite polarity particles in the developer, with the result that the suppression effect of carrier deterioration of the opposite polarity particles cannot be exhibited sufficiently. Thus, the toner charging ability of the carrier is considered to be reduced at the time of printing the 100,000th sheet. It should be pointed out that no generation of memory effect (residual image) was observed in any of the present Examples.

As will be apparent from the aforementioned Examples 1 through 20 and Comparative examples 1 through 5, the developer containing the particles having a polarity opposite to that of toner is used as a developer, and a developing apparatus based on hybrid method is used as a developing apparatus. The voltages formed by overlapping the DC voltage on the AC voltage are applied to the developer carrying member and toner carrying member by independent power sources. This arrangement has been demonstrated to be effective in suppressing the carrier deterioration and avoiding the memory effect (residual image). Preferably, an electric field having a supply Epp of $7.0\times10^6$ V/m or more without exceeding $10.0\times10^6$ V/m is formed as an oscillation field formed at the supply Nip. More preferably, as will be apparent from the Examples 21 through 56, even when there are continuous images of lower image ratio, suppression of carrier deterioration can be achieved while reduction in image density is avoided, by forming the electric field having a development Epp of $6.0\times10^6$ V/m or more without exceeding $9.0\times10^6$ V/m as the oscillation field for forming a development Nip, or by forming the electric field having a frequency of 4000 Hz or more without exceeding 10000 Hz.

What is claimed is:

1. A developing-apparatus, comprising:

a developer container that contains a developer including a toner, a carrier for charging the toner, and opposite polarity particles which have a diameter smaller than a diameter of the carrier and are to be charged opposite to a charge polarity of the toner;

a developer carrying member that conveys the toner supplied from the developer container;

a toner carrying member which is provided facing the developer carrying member and receives the toner from the developer on the developer carrying member and to convey the toner;

a first voltage applying section that applies a first voltage which is a first DC voltage overlapped with a first AC voltage to the developer carrying member; and a second voltage applying section that applies a second voltage which is a second DC voltage overlapped with a second AC voltage to the toner carrying member.

2. The developing apparatus of claim 1, wherein the toner is charged negative by the carrier, and an average of the second voltage applied to the toner carrying member by the second voltage applying section is higher than an average of the first voltage applied to the developer carrying member by the first voltage applying section.

3. The developing apparatus of claim 1, wherein the toner is charged positive by the carrier, and an average of the second voltage applied to the toner carrying member by the second voltage applying section is lower than an average of the first voltage applied to the developer carrying member by the first voltage applying section.

4. The developing apparatus of claim 1, wherein a difference between a maximum value and a minimum value of an electric field formed by the first and second voltage applying sections between the developer carrying member and the toner carrying member is not less than $7\times10^6$ V/m and not more than $10\times10^6$ V/m at a closest portion between the developer carrying member and the toner carrying member.

5. The developing apparatus of claim 1, wherein a number average particle diameter of the opposite polarity particles is from 100 to 1000 nm.

6. The developing apparatus of claim 1, further comprising:

a supplying mechanism that supplies the developing apparatus with a toner to which opposite polarity particles are externally added.

7. The developing apparatus of claim 1, wherein the carrier is magnetic, and the opposite polarity particles are nonmagnetic.

8. An image forming apparatus, comprising:

an image carrying member;

an imager forming mechanism that forms an electrostatic latent image on the image carrying member; and a developing apparatus comprising:

a developer container that contains a developer including a toner, a carrier for charging the toner, and opposite polarity particles which have a diameter smaller than a diameter of the carrier and are to be charged opposite to a charge polarity of the toner;

a developer carrying member that conveys the toner supplied from the developer container;

a toner carrying member which is provided facing the developer carrying member and receives the toner from the developer on the developer carrying member and to convey the toner;

a first voltage applying section that applies a first voltage which is a first DC voltage overlapped with a first AC voltage to the developer carrying member; and a second voltage applying section that applies a second voltage which is a second DC voltage overlapped with a second AC voltage to the toner carrying member, wherein the electrostatic latent image on the image carrying member is developed with the toner conveyed by the toner carrying member.

9. The image forming apparatus of claim 8, wherein a difference between a maximum value and a minimum value of an electric field formed by the second voltage applying section between the toner carrying member and the image carrying member is not less than $6\times10^6$ V/m and not more than $9\times10^6$ V/m at a closest portion between the developer carrying member and the toner carrying member.

10. The image forming apparatus of claim 8, wherein a frequency of an electric field formed by the second voltage applying section between the toner carrying member and the image carrying member is not less than 4 kHz and not more than 10 kHz.

11. The image forming apparatus of claim 8, wherein a number average particle diameter of the opposite polarity particles is from 100 to 1000 nm.

12. The image forming apparatus of claim 8, further comprising: a supplying mechanism which supplies the developing apparatus with a toner to which opposite polarity particles are externally added.

13. The image forming apparatus of claim 8, wherein the carrier is magnetic, and the opposite polarity particles are nonmagnetic.

14. A method for forming an image, the method comprising:

supplying a developer carrying member with a developer including a toner, a carrier for charging the toner, and opposite polarity particles which have a diameter smaller than a diameter of the carrier and are to be charged opposite to a charge polarity of the toner;

forming an electric field between the developer carrying member and a toner carrying member by applying a first voltage which is a first DC voltage overlapped with a first AC voltage to the developer carrying member and applying a second voltage which is a second DC voltage overlapped with a second AC voltage to the toner carrying member, the toner being transferred from the developer on the developer carrying member to the toner carrying member; and developing the electrostatic latent image on an image carrying member with the toner on the toner carrying member.

15. The method of claim 14, wherein a difference between a maximum value and a minimum value of an electric field formed between the developer carrying member and the toner carrying member is not less than $7\times10^6$ V/m and not more than $10\times10^6$ V/m at a closest portion between the developer carrying member and the toner carrying member.

16. The method of claim 14, wherein a difference between a maximum value and a minimum value of an electric field formed between the toner carrying member and the image carrying member is not less than $6\times10^6$ V/m and not more than $9\times10^6$ V/m at a closest portion between the developer carrying member and the toner carrying member.

17. The method of claim 14, wherein a frequency of an electric field formed between the toner carrying member and the image carrying member is not less than 4 kHz and not more than 10 kHz.

18. The method of claim 14, wherein the carrier is magnetic, and the opposite polarity particles are nonmagnetic.

* * * * *